United States Patent [19]

Sakashita et al.

[11] 4,271,742

[45] Jun. 9, 1981

[54] SOUND GENERATOR FOR PRODUCING ANGKLONG LIKE SOUND

[75] Inventors: Masao Sakashita; Yoshiaki Matsuura, both of Saitama, Japan

[73] Assignee: Kabushiki Kaisha Kawai Gakki Seisakusho, Hamamatsu, Japan

[21] Appl. No.: 93,079

[22] Filed: Nov. 9, 1979

[30] Foreign Application Priority Data

Aug. 28, 1979 [JP] Japan ..... 54/109585

[51] Int. Cl.[3] ..... G10H 1/02

[52] U.S. Cl. ..... 84/1.26; 84/1.24

[58] Field of Search ..... 84/1.24, 1.26, 1.13; 340/384 E, 384 R

[56] References Cited

U.S. PATENT DOCUMENTS

| | | | |
|---|---|---|---|
| 3,746,774 | 7/1973 | Adachi | 84/1.26 |
| 3,821,458 | 6/1974 | Schreier | 84/1.26 |
| 3,971,283 | 7/1976 | Wayne, Jr. | 84/1.13 |
| 4,012,702 | 3/1977 | Weber | 84/1.13 |
| 4,178,825 | 12/1979 | Deutsch | 84/1.24 |
| 4,181,059 | 1/1980 | Weber | 84/1.24 |
| 4,194,426 | 3/1980 | Deutsch et al. | 84/1.26 |

*Primary Examiner*—Stanley J. Witkowski
*Assistant Examiner*—Forester W. Isen
*Attorney, Agent, or Firm*—Sughrue, Rothwell, Mion, Zinn and Macpeak

[57] ABSTRACT

An electronic sound generator is developed for generating a sound similar to that of ANGKLONG (Indonesian terms), which comprises a circuit for generating a series of consequtive rectangular waves. A plurality of envelope wave generation circuits each produce an envelope wave having the same repeating cycle as that of each said rectangular wave and, one or more sound source circuits are used for generating signals substantially equal to the output waves of angklong, circuits in each of which an output of a sound source circuit is modulated by the relevant envelop wave. A loudspeaker sounds the modulated signal as a musical sound. In a record embodiment the sound generator further comprises a first gate to which the modulated signal is directly applied, a second gate is connected in series with the volume and/or tone control circuit, means for opening said first and second gates alternatively and a means for combining the outputs of said first and second gates to provide a musical sound from the loudspeaker.

7 Claims, 8 Drawing Figures

SOUND GENERATOR FOR PRODUCING ANGKLONG LIKE SOUND

BACKGROUND OF THE INVENTION

This invention relates to an electronic musical instrument capable of generating a musical sound similar to the one called in terms of ANGKLONG (Indonesian terms).

Angklong is a folk-music instrument which has been used from ancient times in South East Asian countries such as East Indian Islands and has such structure as will be described hereinafter.

The prior art electronic musical instrument of this kind has such structure as to provide two kinds of musical sounds different in pitch and appearing alternatively in time sharing principle as is found in producing marimba like sound. However none of those instruments are provided with such structure to superpose two kinds of sounds having the same or different pitch and a slight relative time lag in order to generate, with a certain repetition cycle, a composite sound resulting from the superposition.

SUMMARY OF THE INVENTION

An object of this invention is to provide a simple circuit configuration for generating a musical sound similar to that of angklong.

DETAILED DESCRIPTION OF THE INVENTION

First, an explanation will be made on the musical instrument named by ANGKLONG.

Figure 1:
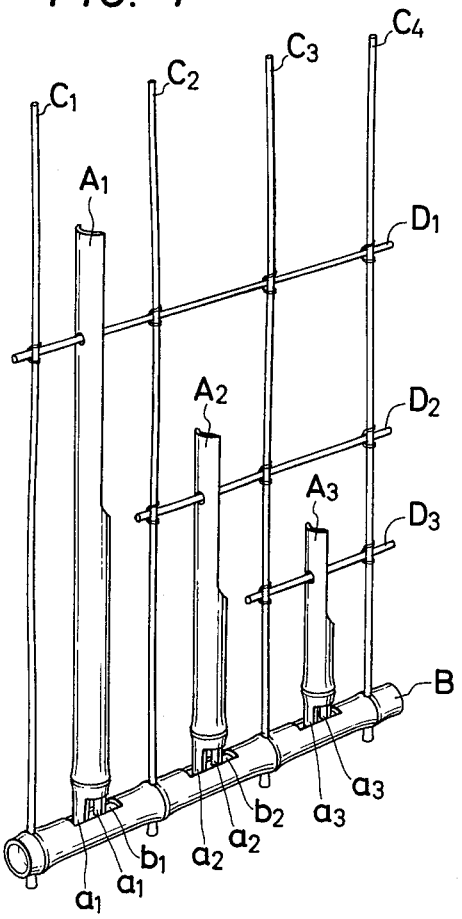
FIG. 1 is a brief perspective view of the angklong.
Figure 2:
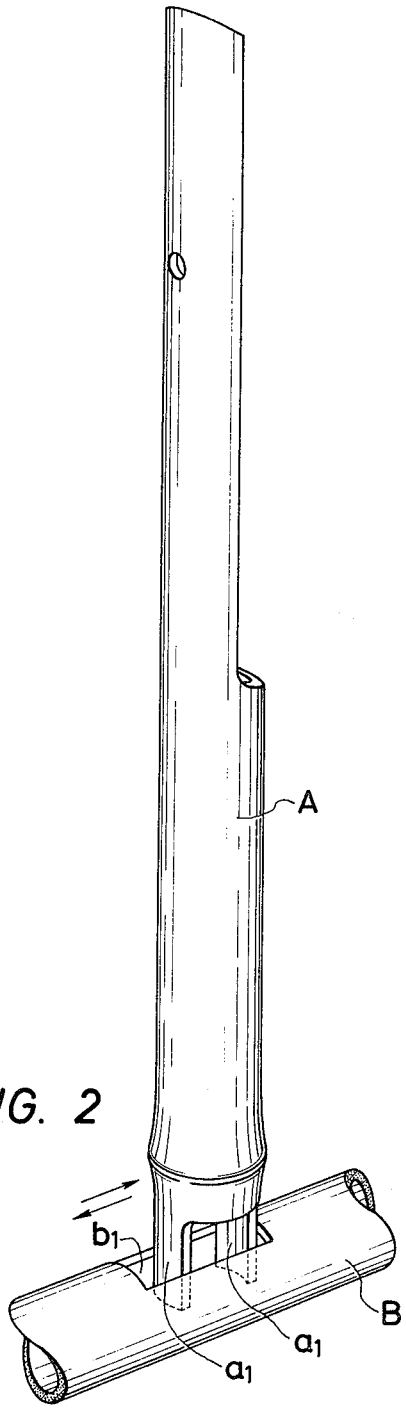
FIG. 2 is a perspective view showing the detail of a part of the angklong.

As shown in FIG. 1, the angklong comprises several bamboo cylinders or tubes A1, A2, A3, . . . arranged parallel in vertical direction, the lower end of each bamboo cylinder being cut into a forklike portion a1, a1, a2, a2, a3, a3, . . . . The forklike portions are slightly inserted into small holes b1, b2, . . . bored on a bamboo cylinder B placed in horizontal direction. At the horizontal bamboo cylinder B, thin rods or vertical frames C1, C2, C3, . . . are inserted and secured in vertical direction. Each vertical bamboo cylinder A1, A2, A3, . . . is cut off about half of its thickness at its upper portion where a through hole is bored for transverse rod frame. The transverse rod frames D1, D2 and D3 are fixed at the vertical frames C1, C2, C3, . . . as shown in the figure.

When the angklong is shaked in the longitudinal direction of the horizontal bamboo cylinder B, all the vertical bamboo cylinders A1, A2 and A3 swing in the same direction, so that the forklike portions a1, a1, a2, a2, . . . at the feet of respective bamboo cylinders move back and forth along the longitudinal lines of the small holes b1, b2, . . . and produce percussive sounds every time they hit the ends of the small holes. The pitch of a sound to be generated by each vertical bamboo cylinder is determined in accordance with the length and diameter of the cylindrical or tubular part of the vertical bamboo cylinder. The lengths and diameters of these bamboo cylinders are adjusted in such manner as to realize the relation of an octave or fifth degree. Since the forklike portions at the feet of bamboo cylinders hit one ends of respective holes b1, b2, . . . at slightly different moments from each other, the generated sounds are superposed with a slight time lag, giving a light musical sound that sounds "Klong, Klong".

In a musical performance, a player plays one or two angklongs and a group of players each making his own sound cooperate to make a rhythm. To sustain the musical sound of the angklong, the player must shake his hands skillfully.

Figure 3:
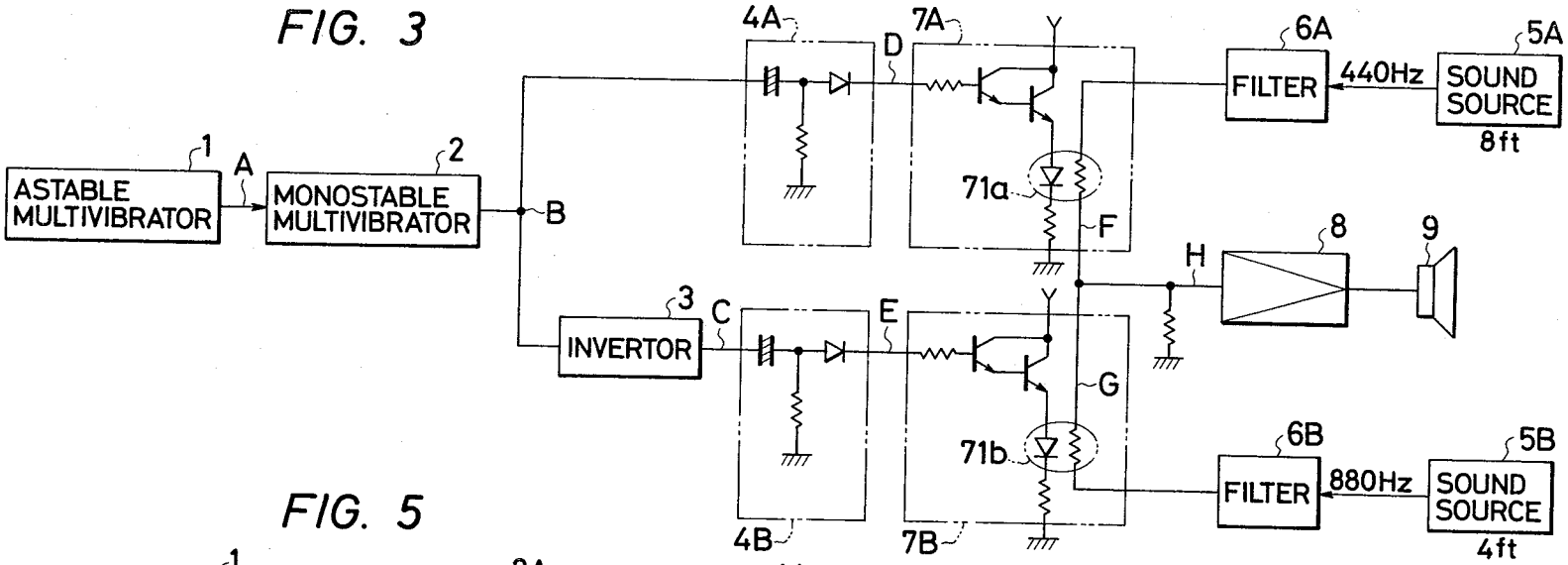
FIG. 3 is a block diagram illustrating a first embodiment of this invention.

FIG. 3 is a block diagram illustrating a first embodiment of this invention. The block numbered by 1 is an astable multivibrator for consecutive generation of rectangular waves (waveform A in FIG. 4) with a given repetition cycle. Block 2 is a monostable nultivibrator for generating a series of rectangular waves (waveform B in FIG. 4) with duration time t in response to the falling edges of the waveform A. Block 3 is an inverter for providing waveform C in FIG. 4, and blocks 4A and 4B are envelope circuits the output waveforms of which are respectively shown in D and E of FIG. 4. Blocks 5A and 5B are sound sources for generating signals with their respective frequencies corresponding to those of the sounds produced with the vertical bamboo cylinders of the angklong. Blocks 6A and 6B are tone formation filters fed from respective sound source circuits and outputting signals similar in waveform to those of the angklong. Blocks 7A and 7B are modulation circuits respectively driven by the output D and E of said envelope circuits 4A and 4B to modulate the output of said tone formation filter 6A and 6B for producing modulated signals F and G shown in FIG. 4. Blocks 71*a* and 71*b* are photo-couplers for modulation, each of which has a light emitting diode excited by the envelope wave to generate a light to a corresponding photoconductor for controlling the conductivity of it. The amplifier 8 amplifies said two kinds of signals F and G, and supplies a signal of the waveform H in FIG. 4 to a loudspeaker 9, where it is sounded as a musical sound.

Figure 4:
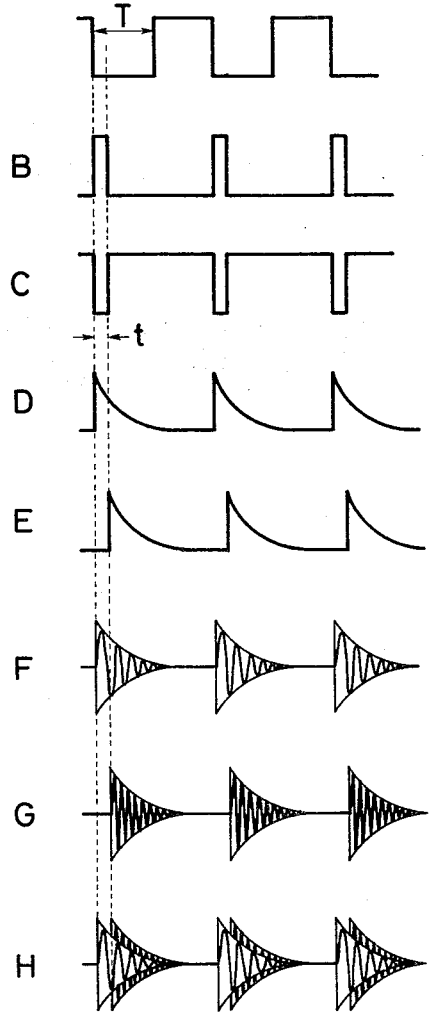
FIG. 4 shows waveforms at each part of the embodiment in FIG. 3.

The rectangular wave having its duration T, being shown in A of FIG. 4, is generated at the output of the astable multivibrator 1, the falling edge of which triggers the monostable multivibrator 2 to give the waveform B of FIG. 4. C of FIG. 4 shows a waveform derived from the waveform B of FIG. 4 phase-inverted at the inverter 3. Waveforms D and E of FIG. 4 are produced by differentiating the waveforms B and C of FIG. 4 at envelope circuits 4A and 4B.

As shown in FIG. 3, the signals having, for example, repetition cycles of 440 Hz and 880 Hz obtained from the sound source circuits 5A and 5B are respectively applied to filters 6A and 6B which pass through the musical sound signals similar to those of the angklong. The sound source signals passed through the filters are amplitude modulated at the photocouplers 71*a* and 71*b* in the modulation circuits 7A and 7B, giving two musical sounds one octave different in pitch and with time lag equal to the duration t of the monostable multivibrator 2. The two sounds are mixed and amplified at the amplifier 8 and sounded from the loudspeaker 9 as a musical sound.

In this embodiment, two envelope waveforms D and E of FIG. 4 with the time lag t are produced by differentiating and inverting, but it is apparent that the equivalent effect will be obtained by using such a means as delay line to directly delay the output of the astable multivibrator 1 before applying it to the invertor 3 and the envelope circuit 4B. The outputs of the sound source circuits 5A and 5B can be combined in various manners such as 220 Hz and 440 Hz which is in relation of an octave with 220 Hz, or 440 Hz and 660 Hz which is in relation of fifth degree with 440 Hz.

Figure 5:
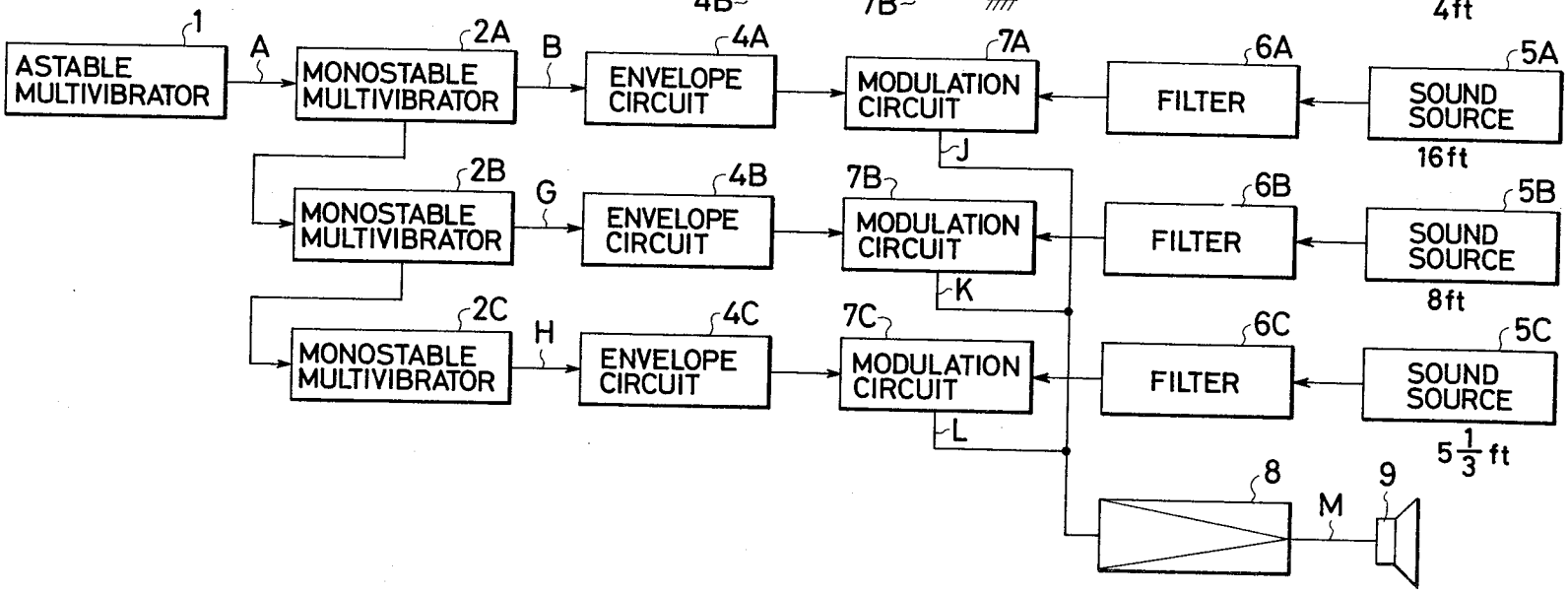
FIG. 5 is a block diagram illustrating a second embodiment of this invention.
Figure 6:
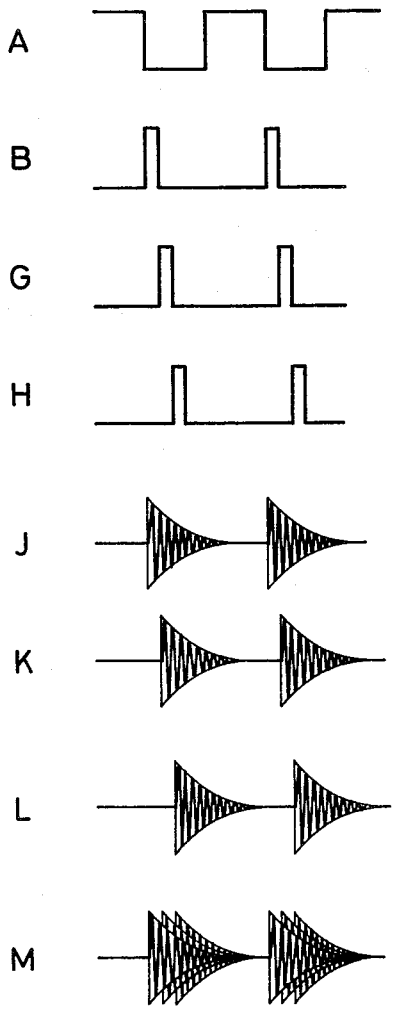
FIG. 6 shows waveforms at each part of the embodiment in FIG. 5.

FIG. 5 is a block diagram illustrating a second embodiment of this invention. The same symbols as those in FIG. 3 indicate the same or the equivalent parts. The sound generator of this embodiment comprises three monostable multivibrators 2A–2C, envelope circuits 4A–4C, modulation circuits 7A–7C, sound source circuits 5A–5C and tone formation filters 6A–6C. Each of monostable multivibrators 2A and 2B applies its output to the monostable multivibrator in the next stage as trigger input. And each monostable multivibrator 2A–2C supplies its output to the corresponding envelope circuit 4A–4C. The operation is the same as that of the sound generator of FIG. 3. FIG. 6 shows waveforms of each part of the sound generator of FIG. 5. In this embodiment, three kinds of musical sound signals, for example, of 220 Hz, 440 Hz and 660 Hz (J–L in FIG. 6) are superposed with time lag equal to the on-time of the monostable multivibrators 2A–2C, the resultant signal (M in FIG. 6) is sounded from the loudspeaker 9 as a musical sound.

Figure 7:
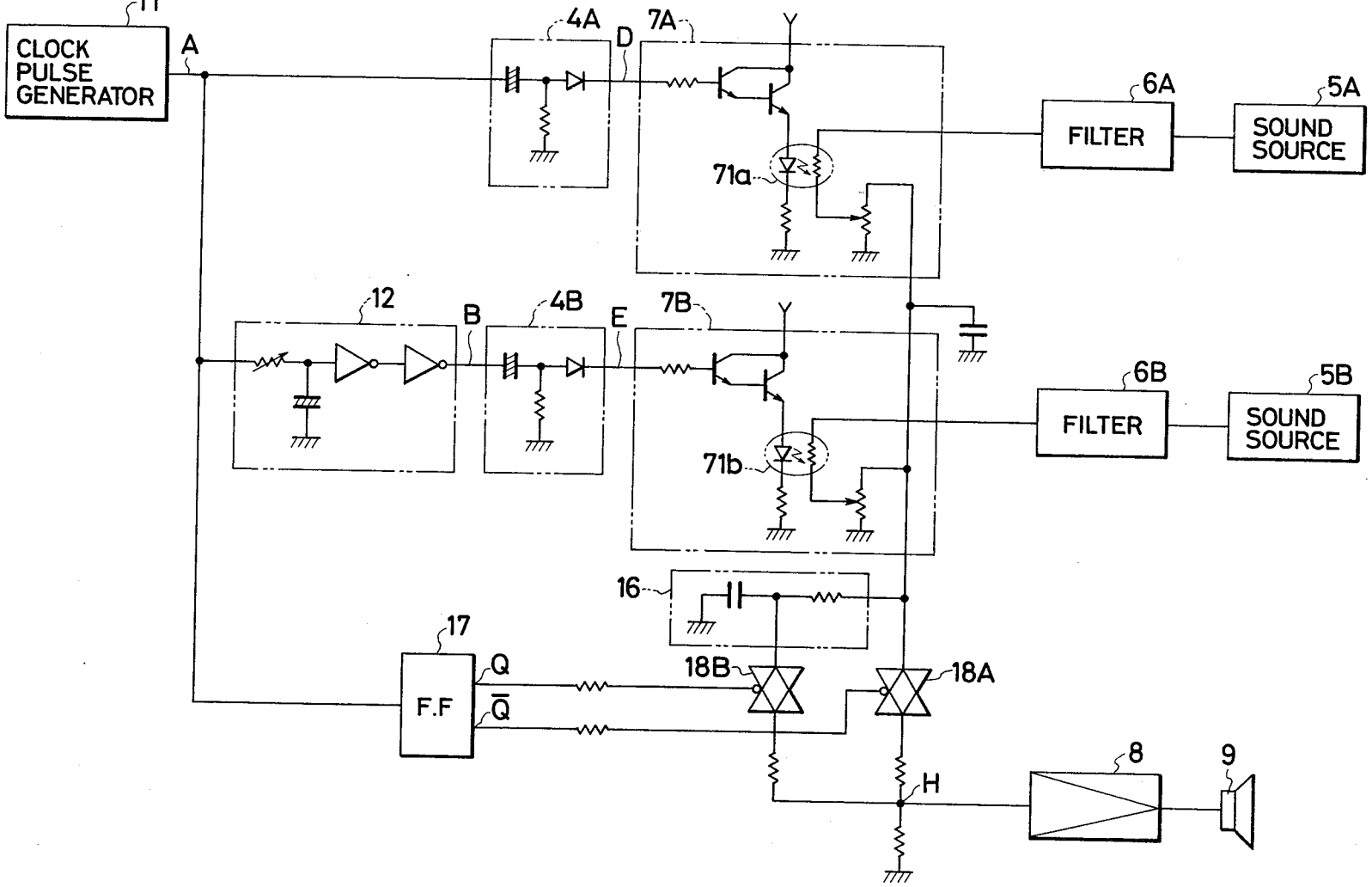
FIG. 7 is a block diagram illustrating a third embodiment of this invention.

FIG. 7 shows a third embodiment of this invention. The same symbols as those in FIGS. 3 and 5 indicate the same or the equivalent parts. The block numbered by 11 is a clock pulse generator for generating clock pulses (A in FIG. 8) with the repetition cycle nearly equal to the time interval between two successive sounds of the angklong: i.e., one produced when the forklike portion hits one side of the hole on the horizontal bamboo cylinder B and the other produced when it is reflected back to the other end of the hole and hits it. Block 12 is a delay circuit which delays the waveform A by the time t equal to the time lag between the sounds generated by two vertical bamboo cylinders of the angklongs, providing output waveform B of FIG. 8. In the example shown in the figure, the delay circuit 12 comprises an integration circuit for clock wave A and two inverters, but some other constructions may be employed in which, for example, the clock pulse wave is deformed, amplitude of it limited and then amplified.

As described hereinbefore, each of the two vertical bamboo cylinders of the angklong provides two kinds of sound: i.e., one produced at a moment when the forklike portion hits an end of the hole on the horizontal bamboo cylinder and the other at another moment when the other side of the forklike portion hits the other end of the hole. Those sounds are often a bit different in tone and volume. Block 16 is a filter for producing said difference in tone and volume, block 17 is a flip-flop circuit with its output turned over in response to rising edge of wave A of FIG. 8, and blocks 18A and 18B are analog gate circuits.

Figure 8:
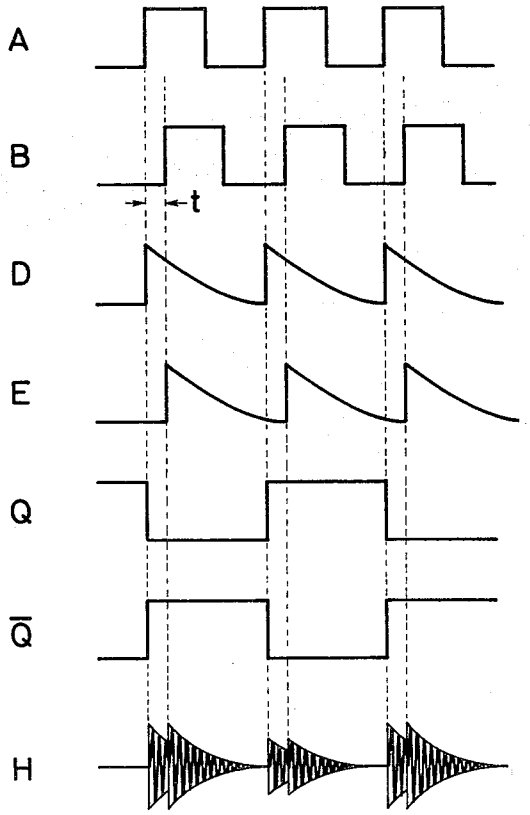
FIG. 8 shows waveforms at each part of the embodiment in FIG. 7.

As is easily understood from FIG. 7, a portion of output (A in FIG. 8) of the clock pulse generator 11 is fed through delay circuit 12 to envelope circuit 4B and transformed into an envelope wave E in FIG. 8, while another portion is applied directly to envelope circuit 4A, where it is transformed to another envelope wave D as shown in FIG. 8.

These envelope waves D and E are respectively fed to modulation circuit 7A and 7B to modulate the outputs from filters 6A and 6B at the photo couplers **71*a* and 71*b*. The output waveforms of photo couplers 71*a* and 71*b* are superposed together and supplied directly to analog gate 18A and through filter 16 to analog gate 18B. The flip-flop circuit 17, being driven by the output of clock pulse generator 11, alternatively turns its outputs Q and $\overline{Q}$ to "High" level (See FIG. 8) with the cycle of the clock pulse A, which open analog gates 18A and 18B by turns. As is obvious from said description, the output of the second analog gate 18B is changed in tone quality and a bit smaller in volume than that of the first analog gate 18A. The outputs of analog gates 18A and 18B appear alternatively with the cycle of the clock pulse (A in FIG. 8). The composite output is continuous in time and has the waveform of H in FIG. 8**.

In the explanation of the third embodiment, the musical sound signal supplied to the second analog gate 18B was different in both of tone quality and volume or amplitude from the musical sound signal supplied to the first analog gate 18A, but changing either one of the tone quality and volume may be acceptable.

Thus, according to the present invention, an electronic musical instrument can take the place of actual angklong instrument in generating a musical sound similar to that of angklong, extending its application. Moreover, adjustment of circuit constants of the electronic circuit enables the fine adjustment of generation time lag between musical sounds, repetition cycle of the musical sounds with the same or different pitches, and volume and tone of each musical sound, so that more extensive application than the actual angklong will be found in a musical performance such as solo and concert.

What we claim is:

1. A sound generator for producing sounds similar to those of an angklong, comprising:

a circuit for generating a series of consecutive rectangular waves, envelope circuits each providing an envelope wave having the same period as that of each said rectangular wave, a sharp rising leading edge followed by gradual decay and a given time lag relative to each other that is short when compared to a half period of said rectangular wave, sound source circuit means incorporated for generating output signals having a waveform substantially equal to an output waveform of the angklong, modulation circuits for modulating the output signals of the sound source circuit means with the respective envelope waveforms, means for superposing the outputs of the modulation circuits, and means for sounding the superposed signal from a loudspeaker as a musical sound.

2. A sound generator for producing sounds similar to those of an angklong according to claim 1, wherein the output frequencies of the sound source circuit means are different from each other.

3. A sound generator for producing sounds similar to those of an angklong, comprising:

a circuit for generating a series of consecutive rectangular waves, envelope circuits each providing an envelope wave having the same period as that of each said rectangular wave, a sharp rising leading edge followed by gradual decay and a given time lag relative to each other that is short when compared to a half period of said rectangular wave, sound source circuit means incorporated for generating output signals having a waveform substantially equal to an output waveform of the angklong, modulation circuits for modulating the output signals of the sound source circuit means with the respective envelope waveforms, a first gate directly supplied the outputs of the modulation circuits, a second gate connected in parallel with said first gate and in series with a sound control circuit, means for opening said first and second gates alternately with the same period as that of each said rectangular wave, means for combining the outputs of said first and second gates, and means for providing a musical sound from a loudspeaker.

4. A sound generator for producing sounds similar to those of an angklong according to claim 3, wherein the output frequencies of the sound source circuit means are different from each other.

5. A sound generator for producing sounds similar to those of an angklong according to claims 1, 2, 3 or 4 wherein said source generating means comprises at least two sound source circuits.

6. A sound generator for producing sounds similar to those of an angklong according to claim 3 wherein said sound control circuit comprises a tone circuit.

7. A sound generator for producing sounds similar to those of an angklong according to claim 3 wherein said sound control circuit comprises a volume circuit.

* * * * *